United States Patent [19]

Terasaki

[11] 4,370,988

[45] Feb. 1, 1983

[54] CIGARETTE HOLDER SMOKE FILTERING CARTRIDGE WITH TWO STAGE SMOKE PURIFICATION ACTION

[76] Inventor: Masahiro Terasaki, 43, Okimiyacho, Edogawa-ku, Tokyo, Japan

[21] Appl. No.: 294,244

[22] Filed: Aug. 19, 1981

[30] Foreign Application Priority Data

Dec. 24, 1980 [JP] Japan ..... 55-187076[U]

[51] Int. Cl.[3] ..... A24D 1/04

[52] U.S. Cl. ..... 131/201; 131/202; 131/210; 131/211; 131/215 R; 131/215 A; 131/216; 131/339

[58] Field of Search ..... 131/198 R, 198 A, 336, 131/338, 339, 341, 201, 202, 205, 210, 211, 212 R, 212 A, 213, 215 R, 215 A, 215 B, 216, 218

[56] References Cited

U.S. PATENT DOCUMENTS

| | | | |
|---|---|---|---|
| 3,777,765 | 12/1973 | Yoshinaga | 131/339 |
| 3,877,470 | 4/1975 | Jewett et al. | 131/212 A |
| 4,120,310 | 10/1978 | Lee et al. | 131/212 A |
| 4,254,782 | 3/1981 | Ligetti | 131/339 |
| 4,292,983 | 10/1981 | Mensik | 131/339 |

FOREIGN PATENT DOCUMENTS

| | | | |
|---|---|---|---|
| 1365712 | 3/1964 | France | 131/339 |
| 6605710 | 10/1966 | Netherlands | 131/339 |

*Primary Examiner*—V. Millin

*Attorney, Agent, or Firm*—Birch, Stewart, Kolasch & Birch

[57] ABSTRACT

The outer shell of a removable smoke filtering cartridge for fitting inside a cigarette holder is formed from two coaxially abutting tubes separated by a wall with a hole. A tubular inner lip around the hole extends into the space within the first tube, a trough being defined around this lip. A cup is mounted within the first tube remote and facing away from the wall, intercepting across the first tube except for one or more narrow spaces defined between the cup and the first tube inner wall. The parts of these narrow spaces nearer the wall communicate to the space between the cup and the wall. One or more small apertures are formed through the side wall of the cup and communicate the space within the cup to the narrow spaces. A disk is mounted across the first tube against the side of the cup remote from the wall. Smoke passes through a hole in the disk into the space within the cup, passes through the small apertures to enter the narrow spaces, and impinges against the inner wall of the tube, to which the larger tar particles in the smoke stick. Then the smoke passes through the narrow spaces, sweeping these tar particles along and depositing them in the trough, and passes through the hole in the wall into a filter mounted within the second tube, which purifies the smoke of some of the smaller tar particles still in it.

13 Claims, 6 Drawing Figures

CIGARETTE HOLDER SMOKE FILTERING CARTRIDGE WITH TWO STAGE SMOKE PURIFICATION ACTION

BACKGROUND OF THE INVENTION

The present invention relates to a cigarette holder which is provided with a tar removing cartridge for filtering the smoke passing through said cigarette holder, and, more particularly relates to an improved structure for such a tar removing cartridge, which gives it a superior performance in filtering tobacco smoke.

In the past, a number of different structures have been proposed for a cigarette holder equipped with a tar removing cartridge. Many of these have had a renewable tar removing cartridge. Such a renewable cartridge can be removed from the cigarette holder when the cartridge's efficiency in filtering smoke has dropped below an acceptable level, and can then be replaced by a fresh cartridge.

The filtering effect of such a tar removing cartridge needs to be durable, because the user will be reluctant frequently to change the cartridge. Thus, the number of cigarettes whose smoke can be passed through the tar removing cartridge, before the efficiency of the tar removal action provided by said cartridge is deteriorated to an unacceptable level, is a critical factor with regard to the design of such a cartridge. Further, low cost of mass production of the cartridge is also a critical factor, because the salability of such goods is rather price sensitive.

Further, in view of the desirability of providing a good filtering effect for the tobacco smoke passed through such a tar removing cartridge, which is very important in view of the severely high rates of lung cancer, bronchitis, heart disease, and other ailments directly attributable to smoking of tobacco, it is important that the percentage of the tarry substances present in tobacco smoke which are removed therefrom by such a tar removing cartridge should be high at all times during its usable life span. In other words, the tar catching ratio, or the efficiency of catching tarry particles, should be high initially, and should remain quite high, until the cartridge is ready to be discarded for a fresh one.

Conventional tar collecting cartridges based upon the principle of ejecting the tobacco smoke against a barrier wall so that tarry particles are caught by the barrier wall while the smoke gases only are diverted away from the barrier wall have the general advantage that they have a relatively large tar collecting capacity, while on the other hand they have the general disadvantage that they are rather deficient in removing finer and smaller tarry particles.

A simple filter device such as is conventionally used for a filter tip for a cigarette is not properly suitable for use by itself for a tar removing system for such a tar removing cartridge, because, although such a filter device is effective at removing a large proportion of the tarry particles from smoke including the finer or smaller particles, it tends very quickly to become choked or clogged up with the coarser or larger tarry particles, and thus to lose its filtering ability. This effect means that the usability of such a filter device is really best restricted to applications wherein it is only required to filter the smoke so as to remove the finer or smaller particles which are not great in amount.

SUMMARY OF THE INVENTION

Accordingly, it is the primary object of the present invention to provide such a renewable tar removing cartridge for a cigarette holder, which has a high efficiency of tar removal, and which can be used to process the smoke of quite a number of cigarettes before its performance is seriously adversely affected.

It is a further object of the present invention to provide such a renewable tar removing cartridge for a cigarette holder, which does not quickly become choked up by the larger or coarser tar particles present in the smoke.

It is a further object of the present invention to provide such a renewable tar removing cartridge for a cigarette holder, which is able to cope with both the larger or coarser and the smaller or finer tar particles present in the smoke, and which can provide a good performance of purifying the smoke of both such types of particles.

It is a further object of the present invention to provide such a renewable tar removing cartridge for a cigarette holder, which incorporates both a large tar particle catcher and also a small tar particle catcher.

It is a further object of the present invention to provide such a renewable tar removing cartridge for a cigarette holder, which provides a certain amount of turbulence in the smoke, before the smoke enters the large particle catcher.

It is a yet further object of the present invention to provide such a renewable tar removing cartridge for a cigarette holder, which provides a backup system for catching larger tar particles, to aid said large tar particle catcher.

It is a yet further object of the present invention to provide such a renewable tar removing cartridge for a cigarette holder, which is of a simple construction.

It is a yet further object of the present invention to provide such a renewable tar removing cartridge for a cigarette holder, which is cheap and easy to produce in quantity.

It is a yet further object of the present invention to provide such a renewable tar removing cartridge for a cigarette holder, which will aid in the prevention of diseases such as lung cancer, bronchitis, heart disease, and other ailments directly attributable to smoking of tobacco.

According to the present invention, these and other objects are accomplished by, for a cigarette holder comprising a cigarette receiving member formed with a smoke intake passage and adapted to receive a cigarette so as to supply the smoke from said cigarette to said smoke intake passage, and a mouthpiece member formed with a smoke outlet passage and adapted to be sucked by the mouth of a user, said cigarette receiving member and said mouthpiece member being selectively detachably joined together, and a cartridge receiving chamber being defined within said cigarette holder by the cooperation of said cigarette receiving member and said mouthpiece member when they are so joined together, said smoke intake passage and said smoke outlet passage communicating to opposite ends of said cartridge receiving chamber: a cartridge, for being fitted into said cartridge receiving chamber and for purifying smoke sucked into said smoke intake passage and sucked out of said smoke outlet passage, thus passing through said cartridge receiving chamber, comprising: (a) an outer shell, comprising: a first hollow tubular portion; a second hollow tubular portion, connected substantially coaxially with said first hollow tubular portion; a dividing wall portion, generally separating the interior space within said first hollow tubular portion from the interior space within said second hollow tubular portion, extending generally perpendicularly to the central axis of said first and second hollow tubular portions, and formed with a hole, said hole communicating said interior spaces within said first and second hollow tubular portions; and a tubular inner lip, which extends all around the periphery of said hole formed in said dividing wall, and which extends from said periphery of said hole formed in said dividing wall in the direction of said central axis of said first hollow tubular portion on the side of said dividing wall portion towards said first hollow tubular portion; (b) a cup member, formed with a substantially cylindrical tubular side wall portion and a bottom portion, mounted within said first hollow tubular portion at a position therein remote from said dividing wall portion with the central axis of said substantially cylindrical tubular side wall portion thereof substantially in coincidence with said central axis of said first hollow tubular portion, and with the open end of said cup member facing away from said dividing wall; said cup member intercepting across said interior space within said first hollow tubular portion except for a set of one or more relatively narrow spaces defined between the outer wall surface of said cup member and the inner wall surface of said first hollow tubular portion, the parts of said relatively narrow spaces nearer said dividing wall portion being communicated to the interior space within said first hollow tubular portion between said cup member and said dividing wall portion; a set of one or more relatively small apertures being formed through said side wall portion of said cup member and communicating between said interior space within said cup member and said set of relatively narrow spaces; (c) a disk member, mounted so as to extend completely across said interior space within said first hollow tubular portion on the side of said cup member remote from said dividing wall portion, and generally contacting, with its side which faces towards said cup member, the edge of said substantially tubular side wall portion of said cup member remote from said bottom thereof; a hole being formed through said disk member and communicating the space on the side of said disk member remote from said cup member with said interior space within said cup member; said space on said side of said disk member remote from said cup member being communicated with said interior space within said first hollow tubular portion between said cup member and said dividing wall portion only via, in the specified order: said hole formed through said disk member, said interior space within said cup member, said set of relatively small apertures formed through said side wall of said cup member, and said set of relatively narrow spaces defined between said side wall portion of said cup member and said inner wall of said first hollow tubular portion; and (d) a filter, mounted in said interior space within said second hollow tubular portion so as to intercept passage of smoke from said hole in said dividing wall portion towards the end of said second hollow tubular portion remote from said dividing wall portion.

According to such a structure, the smoke is subjected to a two stage filtration action: first the larger or coarser tar particles are removed from said smoke by being impinged against and stuck to the inner wall surface of said first hollow tubular member; and then subsequently the smaller or finer tar particles are removed from said smoke, by passing said smoke through the filter. This double purification action means that the means provided for removal of the finer tar particles, i.e. the filter, is effectively prevented from being quickly choked by coarse tar particles present in the smoke, because said coarser tar particles are removed from out of the smoke before it is supplied to said filter.

Further, according to a particular aspect of the present invention, these and other objects are more particularly and concretely accomplished by a cartridge as described above, further comprising a tubular inner lip, which extends all around the periphery of said hole formed in said disk member, and which extends, from said periphery of said hole formed in said disk member in the direction of said central axis of said first hollow tubular portion on the side of said disk member towards said cup member, into said cup member.

According to such a structure, because said tubular lip delivers smoke into a position somewhat deeply within said cup member, thereby this smoke is forced to reverse its direction of motion through an angle of almost 180° before passing through the relatively small apertures so as to be impinged against the inner wall surface of said first hollow tubular member. This forced reversing of direction of motion of the smoke causes a considerable amount of turbulence in the smoke, and this turbulence aids in causing the larger tarry particles therein to stick to said inner wall surace of said first hollow tubular member.

Further, according to a particular aspect of the present invention, these and other objects are more particularly and concretely accomplished by such a cartridge as described above, wherein said cup member is formed with a plurality of ribs on the outer cylindrical surface of its said substantially cylindrical tubular side wall portion which extend along generatrices thereof; said ribs bearing against said inner wall surface of said first hollow tubular portion so as to maintain a predetermined mutual positioning between said outer cylindrical surface of said substantially cylindrical tubular side wall portion of said cup member and said inner wall surface of said first hollow tubular portion; said set of one or more relatively narrow spaces being thus constituted as a plurality of sectors of a cylindrical shell.

According to such a construction, the aforesaid relatively narrow spaces are simply and easily constituted.

Further, according to a particular aspect of the present invention, these and other objects are more particularly and concretely accomplished by such a cartridge as described above, wherein said set of one or more relatively small apertures formed through said side wall of said cup member are all located very close to said side of said disk member which faces towards and contacts said cup member.

According to such a structure, since it is desirable from the point of view of maintaining a good flowing of the condensed larger tar particles along the inner wall surface of said first hollow tubular member that the smoke flow through the relatively narrow spaces should be essentially unidirectional, i.e. should occur substantially only in the direction towards the dividing wall, because the apertures are very close to the disk member, therefore no parts of these relatively narrow spaces nearest to said inner surface of the disk member remain to be stagnant spaces with no quick and positive gas flow therein. Thus there is no risk of accumulation of tarry particles in such stagnant areas.

Further, according to a particular aspect of the present invention, these and other objects are more particularly and concretely accomplished by such a cartridge as described above, incorporating the above described ribs, wherein said ribs extend a little past said bottom portion of said cup member in the direction away from said disk member to form protuberances which bear against an uneven portion of the internal surface of said first tubular portion; said cup member being clamped between said disk member and said uneven portion, so as to be held in position in said first tubular portion; and wherein further said internal surface of said first tubular portion is substantially formed as two cylindrical surfaces of slightly different diameters which are coaxially abutted, said cylindrical surface more remote from said dividing wall being of slightly larger diameter than said cylindrical surface closer to said dividing wall portion, said uneven portion of said internal surface of said first tubular portion being a step defined where said two cylindrical surfaces meet.

According to such a structure, as the smoke passes from the relatively narrow spaces over this step into the internal space within the smaller inner cylindrical surface of the first tubular member, this smoke is further subjected to an impacting action against said step, and this causes further quantities of tarry particles to be deposited out of the smoke onto the step, whence they join the other tarry particles which have accumulated on the larger inner cylindrical surface and are sliding down past the step to be accumulated in the trough defined on the side of the dividing wall towards said cup member, delimited by said lip thereon. Therefore, the provision of this step provides a secondary coarse tar particle trap, which the smoke must pass before entering the filter. Further, this step provides a step against which the cup member inserted into the first tubular member abuts, so as to be mounted at its predetermined position.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
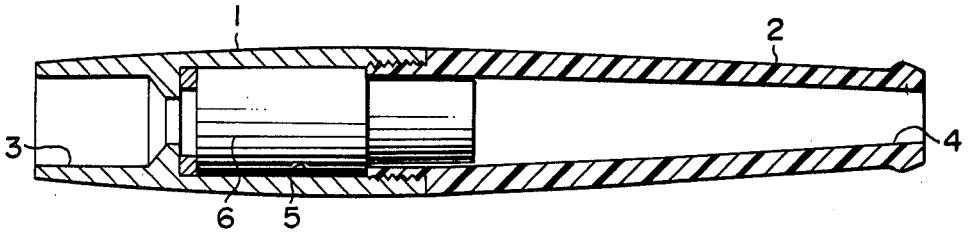
FIG. 1 is a longitudinal sectional view of a generally tubular cigarette holder, which is adapted for removably receiving a cartridge according to the present invention for purifying the smoke inhaled through said cigarette holder, also showing in perspective view a preferred embodiment of the cartridge according to the present invention as fitted in a cartridge chamber defined within said cigarette holder, said sectional view being taken in a plane which includes the central axis of said cigarette holder and of said cartridge.

The present invention will now be described with reference to the preferred embodiment thereof, and with reference to the appended drawings. In the drawings, parts, openings, and gaps are designated by the same reference numerals and symbols throughout all the figures thereof.

FIG. 1 shows a sectional view through a cigarette holder which is designed for using a cartridge according to the present invention. This cigarette holder is made up of a cigarette receiving member 1 and a mouthpiece member 2. The cigarette receiving member 1 is formed with a cigarette mounting portion 3 which is formed as an aperture and is adapted for the non burning end of a lit cigarette to be inserted and jammed thereinto, so as to fix the cigarette in a smoke sealing fashion into the cigarette receiving member 1; and the mouthpiece member 2 is formed with a sucking portion 4 which is adapted to be sucked by the lips of a smoker. Both the cigarette receiving member 1 and the mouthpiece member 2 are formed as hollow tubular members, and are attached together in a coaxial fashion by, in this particular construction, a male thread which is formed on the mouthpiece member 2 being screwingly engaged into a female thread which is formed on the cigarette receiving member 1. Thus, an axially extending smoke passage is defined through the cigarette holder, from the cigarette mounting portion 3 of the cigarette receiving member 1 through to the sucking portion 4 of the mouthpiece member 2.

Within a cartridge chamber 5 defined at an intermediate part of this smoke passage there is fitted a cartridge 6, which is a preferred embodiment of the present invention. The cartridge 6, as will be seen hereinafter, is generally constructed in the form of two cylinders axially abutted together, said cylinders being of somewhat differing diameters; and, corresponding to this, the cartridge chamber 5, in the shown construction, is formed as two cylindrical chambers axially abutted together, the larger of these two cylindrical chambers being defined in the cigarette receiving member 1 and being of a length and diameter adapted snugly to receive the larger of the two cylindrical portions of the cartridge 6, while the smaller of these two cylindrical chambers is defined in the mouthpiece member 2 and is of a size adapted snugly to receive the smaller of the two cylindrical portions of the cartridge 6. In other words, in this shown construction, the junction between the cigarette receiving member 1 and the mouthpiece member 2, i.e.

the place of engagement of the above mentioned two screw threads, is arranged to be, in the axial direction of the cigarette holder, at the junction between the above mentioned two cylindrical chambers. Thus, when the two screw threads are unscrewed from one another, and the cigarette receiving member 1 and the mouthpiece member 2 are separated from one another, then an unserviceable cartridge 6 can be removed from within the cigarette holder, and a new fresh cartridge 6 can be substituted for such an old used one. On the other hand, when the two screw threads are tightened together, and thus the cigarette receiving member 1 and the mouthpiece member 2 are tightly fixed together, a cartridge 6 within the cartridge chamber 5 is tightly held therein, and is prevented from moving therein, both in the axial direction and in the radial direction of the cigarette holder.

Figure 2:
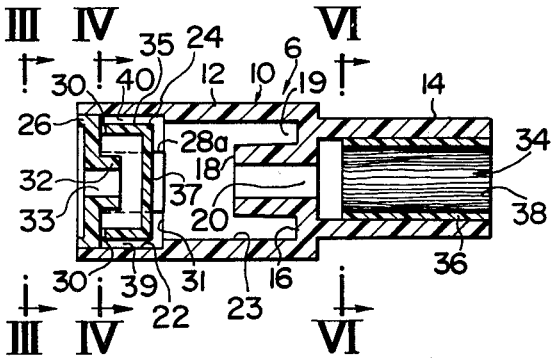
FIG. 2 is a sectional view through said preferred embodiment of the cartridge according to the present invention, for fitting in the cartridge chamber of the cigarette holder shown in FIG. 1, taken in a plane which includes the central axis of said cartridge.
Figure 3:
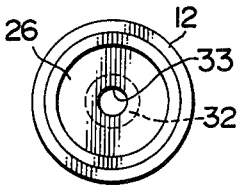
FIG. 3 is an end on view of said preferred embodiment of the cartridge according to the present invention, as seen in a direction indicated in FIG. 2 by the lines III—III.

In FIG. 2, the detailed internal structure of the preferred embodiment of the cartridge according to the present invention can be seen. As mentioned above, the outer shell 10 of this cartridge 6 is constructed in the general form of two hollow tubular portions axially abutted together which are of somewhat differing diameters. The first of these hollow tubular portions 12 (as seen in the direction of progression of smoke through the cartridge 6, and located on the left in FIG. 2) is the one which is of a larger diameter, and as will be seen later this larger diameter hollow tubular portion 12 incorporates in its inside cavity a means for purifying the smoke of its coarser tar particles. On the other hand, the second of these hollow tubular portions 14 (again as seen in the direction of progression of smoke through the cartridge 6, and located on the right in FIG. 2) is the one which is of a smaller diameter, and as will be seen later this smaller diameter tubular portion 14 incorporates in its inside cavity a means for purifying the smoke of its finer tar particles. Thus, in combination, the cartridge according to the present invention is capable of a good performance of purifying smoke of both its finer and its coarser tar particles, without said means for purifying smoke of its finer tar particles running any risk of prematurely becoming choked up with coarser tar particles, because these larger tar particles, before they can reach said means for purifying smoke of its finer tar particles, have already been filtered out from the smoke by said means for purifying smoke of its coarser tar particles.

Between the first tubular portion 12 and the second tubular portion 14, generally separating the inside cavities thereof, there extends a dividing wall portion 16, which is generally perpendicular to the common central axis of said tubular portions 12 and 14. Through the center of said dividing wall portion 16 there is formed a hole 20, which thus communicates the inside cavity of the first tubular portion 12 to the inside cavity of the second tubular portion 14, and all around the edge of said hole 20, extending in the direction towards said first tubular portion 12 and for quite a distance into the inside cavity therein, i.e. to the left in the figure, there is formed a tubular lip 18. Thus, readilly outwards of said tubular lip 18, as seen from the left in FIG. 2, there is defined at the bottom of the interior cavity of said first tubular portion 12 a toroidal trough 19. The purpose of this trough 19 will be explained later.

In the shown preferred embodiment of the present invention, the interior cavity of the first tubular portion 12 is defined by two abutting inner cylindrical surfaces of slightly different diameters. The larger of these, designated by the reference numeral 22, is to the left in the figure of the smaller one, which is designated by the reference numeral 23; and a step 31 facing towards the left in the figure is thus defined where these inner cylindrical surfaces 22 and 23 meet one another. Against this step 31 there is clamped, within the space defined by said larger inner cylindrical surface 22, a cup shaped member 24, which will be described in detail hereinafter, with the open end thereof facing away from the dividing wall 16. This clamping is performed by the pressure of a disk member 26, which is mounted within the end part of the larger inner cylindrical surface 22 of the first tubular portion 12, at the left hand end of the first tubular portion 12 in FIG. 2, so as to extend completely across the opening of the first tubular portion 12 to the left in the figure. In the shown preferred embodiment of the cartridge according to the present invention, this mounting is performed simply by jamming the disk member 26 into the end of said larger inner cylindrical surface 22, because the disk member 26 is constructed to have a slightly larger outer diameter than the inner diameter of the larger inner cylindrical surface 22, when both the disk member 26 and the first tubular portion 12 are in their unstressed states.

Thus, the right hand side in FIG. 2 of the disk member 26 presses against the part of said cup shaped member 24 which extends to the greatest degree to the left in the figure, i.e. against the upper edge of the wall of the cup shaped member 24, and presses the cup shaped member 24 to the right in the figure, so as to impel the parts of said cup member 24 which extend to the greatest degree to the right in the figure against said step 31 defined where the inner cylindrical surfaces 22 and 23 meet one another. The outer edge of the disk member 26 seals against the larger inner cylindrical surface 22 of the first tubular portion 12. A hole 33 is formed through the center of said disk member 26, and as will be explained later this hole 33 communicates a space defined within the cup shape of said cup shaped member 24 to the outside of the cartridge 6 according to the present invention. In the shown preferred embodiment, this disk member 26 is also formed with a tubular lip 32, which extends to the right in FIG. 2, some way into said space defined within the cup shape of said cup shaped member 24, for reasons which will be explained later.

Now, the detailed structure of the cup shaped member 24 will be explained, along with reasons for various features thereof.

Figure 4:
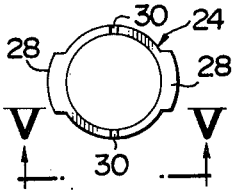
FIG. 4 is an end on view of a cup shaped member incorporated in said preferred embodiment of the cartridge according to the present invention, as seen in a direction indicated in FIG. 4 by the lines V—V, i.e. looking down into the cavity defined in said cup member.
Figure 5:
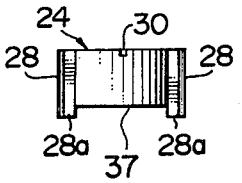
FIG. 5 is a side view of said cup shaped member, as seen in a direction indicated in FIG. 2 by the lines IV—IV.

The cup member 24 is formed with a bottom portion 37 and a substantially cylindrical tubular side wall portion 35, which are conjoined together so as to form a cup shape. Along the outer cylindrical surface of the side wall portion 35, extending in the axial direction of said cylindrical surface (i.e. along generatrices thereof), there are provided a plurality of ribs 28, which project somewhat in the radial direction out from said outer surface of said side wall portion 35. In the shown preferred embodiment, in fact, there are provided two of these ribs 28, which are spaced 180° apart around the periphery of said outer cylindrical surface of said side wall portion 35. These ribs 28 can be seen clearly in FIG. 4 and FIG. 5, and, as can be seen in FIG. 5, the ribs 28 extend somewhat beyond the bottom portion 37 of the cup member 24, to form two small projections 28*a*, but terminate flush with the upper edge of the side wall portion 35 of the cup member 24 remote from the bottom portion 37 thereof. Finally, through the circular upper edge of the cylindrical side wall portion 35 of the cup member 24, there are formed two notches 30, at the two positions equally spaced between the two ribs 28, i.e. at positions 90° away from each of the ribs 28.

Thus, because of the provision of the two ribs 28, the outer cylindrical surface of the side wall portion 35 of the cup member 24 is held a little distance away from the larger inner cylindrical surface 22 of the first tubular portion 12. It is important for the principle of the present invention that this gap formed between the inner cylindrical surface 22 and the outer cylindrical surface of the cup member 24 should be relatively narrow, for reasons which will be explained later. Further, it is important for the principle of the present invention that the notches or apertures 30 should be relatively small, again for reasons which will be explained later. In fact, because the ribs 28 are continuous, two separate spaces 39 and 40 are defined between the outer wall surface 35 of the cup member 24 and the inner cylindrical surface 22 of the first tubular portion 12, to each one of which one of the notches 30 communicates; and this is a useful specialization of the present invention, and explains the reason for the provision of two of the notches 30. Thus, via the notches 30, the spaces 39 and 40 are communicated to the space defined within said cup shaped member 24. Further, because of the provision of the two small projections 28*a* of the ribs 28 extending beyond the bottom portion 37 of the cup member 24, said bottom portion 37 is held a little away from the step 31 defined where the inner cylindrical surfaces 22 and 23 of the first tubular portion 12 meet one another, and thereby these two spaces 39 and 40 are communicated to the internal space within the smaller inner cylindrical surface 23 of the first tubular portion 12. Thus, in summary, the outside space to the left of the cartridge 6 in FIG. 2 is communicated, via in order said hole 33, said space defined within said cup shaped member 24, said notches 30, said two spaces 39 and 40, said internal space within the smaller inner cylindrical surface 23 of the first tubular portion 12, and said hole 20, to the inner space within the second tubular portion 14.

Figure 6:
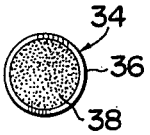
FIG. 6 is an end on view of a filter element incorporated in said preferred embodiment of the cartridge according to the present invention, as seen in a direction indicated in FIG. 2 by the lines VI—VI.

In this inner space within said second tubular portion 14 there is fitted a filter 34, which is formed with a tubular shape. In fact, as can be best seen in FIG. 6, this filter 34 comprises an outer tube 36 made of plastic or the like, which is of an external diameter slightly larger than the inner diameter of the second tubular portion 14. Within this outer tube 36 there is stuffed a bundle 38 formed of a large number of plastic fibers, said fibers extending in the axial direction of said outer tube 36, Thus, the filter 34 is securely jammed into the inner cylindrical surface of said second tubular portion 34.

The operation of this cartridge 6 for purifying smoke of tar particles contained therein will now be described.

When said cartridge 6 is fitted within the cigarette holder shown in FIG. 1, when a lit cigarette is inserted into the cigarette mounting portion 3, and when the mouth of a cigarette user sucks on the sucking portion 4, then cigarette smoke is sucked from the cigarette, into the hole within the cigarette receiving member 1 opening off from the cigarette mounting portion 3, into the left end of the cartridge 6 as seen in FIG. 2 and out from its right end as seen therein, and through the hole in the mouthpiece member 2 opening to the sucking portion 4 into the mouth of the cigarette user. As this smoke is thus sucked through the cartridge 6, it passes in through the hole 33 formed in the disk member 16, past said tubular lip 32 into said space defined within the cup shaped member 24, swirls around within said space defined within said cup shaped member 24, and then rushes through said two notches 30, so as to enter into said two spaces 39 and 40 and so as to impinge against the larger inner cylindrical surface 32 of the first tubular portion 12. At this time, because the notches 30 are quite small, the smoke is moving quite quickly when it thus impinges upon the inner cylindrical surface 22, and, because this impingement occurs at substantially an angle of 90°, the heavier tarry particles within the smoke, which have a substantial inertia relative to air frictional forces acting on their outside surfaces and relative to electrostatic forces and the like which also act on said particles, are dashed against said inner cylindrical surface 22 and are stuck thereto. Thus, the smoke is purified of its coarser tar particles, which remain stuck to said inner cylindrical surface 22.

Thereafter, the smoke proceeds through the two spaces 39 and 40 in the rightwards direction in FIG. 2, passes between the bottom portion 37 of the cup shaped member 24 and the step 31 defined where the inner cylindrical surfaces 22 and 23 meet one another, and enters into the internal space within the smaller inner cylindrical surface 23 of the first tubular portion 12, whence said smoke passes through said hole 20 in said dividing wall 19 into the inner space within the second tubular portion 14. Here, the smoke enters into the left hand side in FIG. 2 of the filter 34, and then passes through the filter 34 wherein it is purified of the finer tar particles which are present in said smoke by said finer tar particles sticking to the sides of the many fibers of the fiber bundle 38 in a per se well known way, the total surface area of all the sides of all said fibers being very large. Subsequently, this more or less purified smoke passes out of the right hand side in FIG. 2 of the filter 34, whence, as explained above, said smoke then is sucked into the mouth and the lungs of the user.

As this purification action proceeds over some time, of course the parts of the larger inner cylindrical surface 22 of the first tubular portion 12 against which the smoke is primarily impinging, i.e. the parts thereof opposing the notches 30, quickly become plasterd with tarry particles. However, because according to the present invention the two spaces 39 and 40 are rather restricted, and hence the smoke and gas velocity in them is rather high, these tarry particles are swept gradually by said gas velocity along said inner cylindrical surface 22, to the right in FIG. 2, over the step 31, and along the smaller inner cylindrical surface 23 in its axial direction, until they are accumulated in the toroidal trough 19. After this, because of the provision of the tubular lip 18, these tarry particles, even when eventually a large quantity of them has accumulated in said trough 19, are effectively prevented from passing through the hole 20 to enter into and choke the filter 34. This is why the provision of the tubular lip 18 is essential for the present invention.

It should be noted that the provision of the step 31 defined where the inner cylindrical surfaces 22 and 23 meet one another, although it is not strictly necessary for the present invention, is a useful specialization thereof. This is because, as the smoke passes from the two spaces 39 and 40 over this step 31 into the internal space within the smaller inner cylindrical surface 23 of the first tubular portion 12, this smoke is further subjected to an impacting action against said step 31, and this causes further quantities of tarry particles to be deposited out of the smoke onto the step 31, whence they join the other tarry particles which have accumulated on the larger inner cylindrical surface 22 and are sliding down past the step 31 to be accumulated in the toroidal trough 19, as explained above. Therefore, the provision of this step 31 provides a secondary coarse tar particle trap, which the smoke must pass before entering the filter 34.

Thus, the smoke is subjected to a two stage filtration action: first the larger or coarser tar particles are removed from said smoke by being impinged against and stuck to the inner cylindrical surface 22 of the first tubular portion 12, as explained above; and then subsequently the smaller or finer tar particles are removed from said smoke, by passing said smoke through the filter 34. This double purification action is essential to the good results obtained from the cartridge according to the present invention; the means provided for removal of the finer tar particles, i.e. the filter 34, is effectively prevented from being quickly choked by coarse tar particles present in the smoke, because said coarser tar particles are removed from out of the smoke before it is supplied to said filter. Thus, a synergistic effect is obtained by the combination of these two tar particle removing constructions, which have somewhat different performance characteristics, which would not be obtained by the use of either of them by itself. In other words, the construction for removing coarser tar particles, i.e. the construction incorporating the cup member 24 etc., is not by itself very good for purifying smoke of tar, because said construction has no purification effect on the finer or smaller tar particles in said smoke, which have no substantial inertia. Further, the construction for removing fine tar particles, i.e. the filter 34, is not by itself very good for purifying smoke of tar, because, although when said construction is actually functioning its purifying effectiveness is good, such a filter, if supplied with raw smoke, is quickly choked by being filled up with the coarser or larger tar particles present in said smoke. On the other hand, when they are used together in the shown order, each of these purifying constructions remedies the defects inherent in the other, thus resulting in a combined smoke purifying construction, i.e. the cartridge according to the present invention, of superior performance characteristics, which is capable of functioning over an extended time period, without becoming choked up.

During this smoke purification process, the action of the tubular lip 32, which extends to a certain distance within the internal space of the cup shaped member 24, is helpful, although not essential to the present invention. Because the smoke which passes through the hole 33 to enter into said internal space is thus delivered to a part of this internal space within the cup shaped member 24 which is quite near the bottom portion 37 thereof, thereby this smoke is forced to reverse its direction of motion through an angle of almost 180° before passing through the notches 30 so as to be impinged against the inner cylindrical surface 22 of the first tubular portion 12. This forced reversing of direction of motion of the smoke causes a considerable amount of turbulence in the smoke, and this turbulence aids in causing the coarser tar particles therein to impinge against and stick to said inner cylindrical surface 22. This is a very useful specialization of the present invention.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention.

For example, the notches 30 could be replaced by small holes bored through the side wall portion 35 of the cup member 24, from its inside cylindrical surface to its outside cylindrical surface, although it is essential to the present invention that such holes should be relatively small, in order to induce a high velocity in the smoke passing therethrough to impinge upon the inner cylindrical surface 22 of the first tubular portion 12, as explained above. Such holes would not need to be formed absolutely at the top edge of the side wall portion 35, at the maximum possible distance away from the bottom portion 37 of the cup member 24, although it is preferable that they should be so positioned, since it is desirable from the point of view of maintaining a good flowing of the condensed larger tar particles along the inner cylindrical surface 22 that the smoke flow through the two spaces 39 and 40 should be essentially unidirectional, i.e. should occur substantially only in the rightwards direction in FIG. 2; and, if such holes or apertures corresponding to the notches 30 are not very close to the inner surface of the disk member 26, then the parts of these spaces 39 and 40 nearest to said inner surface of the disk member 26 will in fact be stagnant spaces, with no quick and positive gas flow therein. This would engender a risk of accumulation of tarry particles in these stagnant areas, and such an accumulation could cause blocking of the apertures corresponding to the notches 30.

Nor is the shown particular construction incorporating the projections 28*a* of the ribs 28 the only possible one; any other construction which allowed communication of the right hand ends in FIG. 2 of the relatively narrow spaces 39 and 40 with the internal space within the smaller inner cylindrical surface 23 of the first tubular portion 12 would be satisfactory. Yet other modifications could also be contemplated, without departing from the spirit of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. For a cigarette holder comprising a cigarette receiving member formed with a smoke intake passage and adapted to receive a cigarette so as to supply the smoke from said cigarette to said smoke intake passage, and a mouthpiece member formed with a smoke outlet passage and adapted to be sucked by the mouth of a user, said cigarette receiving member and said mouthpiece member being selectively detachably joined together, and a cartridge receiving chamber being defined within said cigarette holder by the cooperation of said cigarette receiving member and said mouthpiece member when they are so joined together, said smoke intake passage and said smoke outlet passage communicating to opposite ends of said cartridge receiving chamber:

a cartridge, for being fitted into said cartridge receiving chamber and for purifying smoke sucked into said smoke intake passage and sucked out of said smoke outlet passage, thus passing through said cartridge receiving chamber, comprising:

(a) an outer shell, comprising: a first hollow tubular portion; a second hollow tubular portion, connected substantially coaxially with said first hollow tubular portion; a dividing wall portion, generally separating the interior space within said first hollow tubular portion from the interior space within said second hollow tubular portion, extending generally perpendicularly to the central axis of said first and second hollow tubular portions, and formed with a hole, said hole communicating said interior spaces within said first and second hollow tubular portions; and a tubular inner lip, which extends all around the periphery of said hole formed in said dividing wall, and which extends from said periphery of said hole formed in said dividing wall in the direction of said central axis of said first hollow tubular portion on the side of said dividing wall portion towards said first hollow tubular portion;

(b) a cup member, formed with a substantially cylindrical tubular side wall portion and a bottom portion, mounted within said first hollow tubular portion at a position therein remote from said dividing wall portion with the central axis of said substantially cylindrical tubular side wall portion thereof substantially in coincidence with said central axis of said first hollow tubular portion, and with the open end of said cup member facing away from said dividing wall; said cup member intercepting across said interior space within said first hollow tubular portion except for a set of one or more relatively narrow spaces defined between the outer wall surface of said cup member and the inner wall surface of said first hollow tubular portion, the parts of said relatively narrow spaces nearer said dividing wall portion being communicated to the interior space within said first hollow tubular portion between said cup member and said dividing wall portion; a set of one or more relatively small apertures being formed through said side wall portion of said cup member and communicating between said interior space within said cup member and said set of relatively narrow spaces;

(c) a disk member, mounted so as to extend completely across said interior space within said first hollow tubular portion on the side of said cup member remote from said dividing wall portion, and generally contacting, with its side which faces towards said cup member, the edge of said substantially tubular side wall portion of said cup member remote from said bottom thereof; a hole being formed through said disk member and communicating the space on the side of said disk member remote from said cup member with said interior space within said cup member; said space on said side of said disk member remote from said cup member being communicated with said interior space within said first hollow tubular portion between said cup member and said dividing wall portion only via, in the specified order: said hole formed through said disk member, said interior space within said cup member, said set of relatively small apertures formed through said side wall of said cup member, and said set of relatively narrow spaces defined between said side wall portion of said cup member and said inner wall of said first hollow tubular portion;

and (d) a filter, mounted in said interior space within said second hollow tubular portion so as to intercept passage of smoke from said hole in said dividing wall portion towards the end of said second hollow tubular portion remote from said dividing wall portion.

2. A cartridge according to claim 1, further comprising a tubular inner lip, which extends all around the periphery of said hole formed in said disk member, and which extends, from said periphery of said hole formed in said disk member in the direction of said central axis of said first hollow tubular portion on the side of said disk member towards said cup member, into said cup member.

3. A cartridge according to claim 1, wherein said cup member is formed with a plurality of ribs on the outer cylindrical surface of its said substantially cylindrical tubular side wall portion which extend along generatrices thereof; said ribs bearing against said inner wall surface of said first hollow tubular portion so as to maintain a predetermined mutual positioning between said outer cylindrical surface of said substantially cylindrical tubular side wall portion of said cup member and said inner wall surface of said first hollow tubular portion; said set of one or more relatively narrow spaces being thus constituted as a plurality of sectors of a cylindrical shell.

4. A cartridge according to claim 3, wherein said ribs are two in number, and said relatively narrow spaces are also two in number.

5. A cartridge according to claim 3, wherein said ribs extend a little past said bottom portion of said cup member in the direction away from said disk member to form protuberances which bear against an uneven portion of the internal surface of said first tubular portion; said cup member being clamped between said disk member and said uneven portion, so as to be held in position in said first tubular portion.

6. A cartridge according to claim 5, wherein said disk member is wedged into said first tubular portion and is fixed therein by said wedging.

7. A cartridge according to claim 5, wherein said internal surface of said first tubular portion is substantially formed as two cylindrical surfaces of slightly different diameters which are coaxially abutted, said cylindrical surface more remote from said dividing wall being of slightly larger diameter than said cylindrical surface closer to said dividing wall portion, said uneven portion of said internal surface of said first tubular portion being a step defined where said two cylindrical surfaces meet.

8. A cartridge according to claim 7, wherein said disk member is wedged into said first tubular portion and is fixed therein by said wedging.

9. A cartridge according to claim 1, wherein said set of one or more relatively small apertures formed through said side wall of said cup member are all located very close to said side of said disk member which faces towards and contacts said cup member.

10. A cartridge according to claim 9, wherein said relatively small apertures formed through said side wall of said cup member are formed as small notches taken out of said edge of said substantially tubular side wall portion of said cup member remote from said bottom thereof.

11. A cartridge according to claim 10, wherein said cup member is formed with two ribs on the outer cylindrical surface of its said substantially cylindrical tubular side wall portion which extend along generatrices thereof and which are spaced approximately opposite to one another on said outer cylindrical surface; said two ribs bearing against said inner wall surface of said first hollow tubular portion so as to maintain a predetermined mutual positioning between said outer cylindrical surface of said substantially cylindrical tubular side wall portion of said cup member and said inner wall surface of said first hollow tubular portion; said set of one or more relatively narrow spaces being thus constituted as two sectors of a cylindrical shell; and wherein further said notches are two in number and are located at positions on said edge of said substantially tubular side wall portion of said cup member which are approximately symmetrically located with respect to said two ribs.

12. A cartridge according to claim 1, wherein a part of said cup member remote from said edge of said substantially tubular side wall portion of said cup member which is remote from said bottom thereof bears against an uneven portion of the internal surface of said first tubular portion; said cup member being clamped between said disk member and said uneven portion, so as to be held in position in said first tubular portion.

13. A cartridge according to claim 12, wherein said disk member is wedged into said first tubular portion and is fixed therein by said wedging.

* * * * *